United States Patent [19]

Braun et al.

[11] Patent Number: 4,739,875

[45] Date of Patent: Apr. 26, 1988

[54] COAL PLANING CHAIN AND FEED DEVICE

[75] Inventors: Gert Braun; Ernst Braun, both of Essen-Heisingen; Udo Strucksberg, Düsseldorf, all of Fed. Rep. of Germany

[73] Assignee: Halbach & Braun Industrieanlagen, Fed. Rep. of Germany

[21] Appl. No.: 872,614

[22] Filed: Jun. 10, 1986

[30] Foreign Application Priority Data

Jun. 13, 1985 [DE] Fed. Rep. of Germany ..... 3521182

[51] Int. Cl.[4] ..... B65G 19/28

[52] U.S. Cl. ..... 198/735; 299/34

[58] Field of Search ..... 198/735, 835, 517, 520; 299/34

[56] References Cited

U.S. PATENT DOCUMENTS 4,159,849 7/1979 Rehban ..... 299/34
4,159,850 7/1979 Lobbe et al. ..... 299/34
4,391,471 7/1983 Hauschopp et al. ..... 299/34 X
4,586,753 5/1986 Braun et al. ..... 198/517 X

FOREIGN PATENT DOCUMENTS 268176 3/1968 Austria ..... 299/34

*Primary Examiner*—Stephen J. Novosad
*Assistant Examiner*—William P. Neuder
*Attorney, Agent, or Firm*—McGlew and Tuttle

[57] ABSTRACT

A coal plane guiding device has plane guiding profiles with an upper and a lower chain channel for a planing chain and they are provided with intake gates disposed at both ends of the plane guidance system for the entry of the planing chain. For this purpose, the plane guiding end profiles or attached intake gates have, in the area of the chain channel, an intake spiral of helical nature with a hollow core for the planing chain shaped so that jammed chain links can return helically into their normal position in the course of entering the chain channel.

6 Claims, 3 Drawing Sheets

COAL PLANING CHAIN AND FEED DEVICE

FIELD AND BACKGROUND OF THE DISCLOSURE

This invention relates in general to mining devices and in particular to a new and useful planing chain conveyor trough which has an intake gate for controlling the feed of a planing chain.

The invention relates particularly to a device to guide a coal plane a chain scraper conveyor, with plane guiding profiles which are fastened to the planing trough and have an upper and lower chain channel for the planing chain, the plane guiding end profiles or intake gates disposed on both ends being designed for the entry of the planing chain.

Such plane guidance systems are known, but they often are not satisfactory with respect to the entry of the planing chain or its pulling stringer into the chain channel. As is known, the planing chain must thread itself into the respective chain channel. However, in the course of this threading-in, sometimes jamming occurs because, due to fluctuating loads on the planing system, it is not infrequent that the planing chain is jerked into the chain channel. The result of such jamming is that some chain links position themselves crosswise so that the chain intake is blocked. This results in chain deformations and ultimately chain breakages which lead to considerable operating breakdowns.

SUMMARY OF THE INVENTION

The invention provides a device for the guidance of a coal plane on a planing conveyor trough, which assures entry of the planing chain into the upper and lower chain channels of the plane guidance profiles.

The invention provides plane guiding end profiles or intake gates attached to the plane guidance system which have, at least in the area of the upper chain channel, an intake spiral of helical nature with a hollow core for the planing chain, the axial space between the spiral turns being selected wider by a given dimension and the hollow core diameter being selected larger by a given dimension than the width of the chain links of the planing chain. In addition, the pitch of the spiral turns are selected so that, when sectioning the intake spiral axially, the free spaces between the spiral turns and the adjacent spiral turns are alternately opposite each other. The consequence of these inventive measures is that chain links which may have jammed can turn out of their jammed position into a normal position in the area of the intake spiral so that there is assurance of good chain travel. In fact, the dimensions of the intake spiral can be so matched to the dimensions of the chain links of the respective planing chain that even a chain link which has positioned itself crosswise can be steered out of this position again into the chain travel direction, consequently entering the chain channel without any jamming effect. In this process, the jammed chain link supports itself on and between the spiral turns and consequently performs, in the planing chain channel stressed in tension, an aligning motion of helical nature until it enters the chain channel. The hollow core of the intake spiral is of such diameter that a given clearance for the chain links in normal position, is assured regardless of whether or not they were jammed before. The centerline of the hollow core is always in alignment with the chain channel centerline.

According to the invention, it suffices for the intake spiral to have only two spiral turns, although it may also have more spiral turns. According to another suggestion of the invention it is provided that the inner edges of the spiral turns be designed as roll-off curves or radii of a given size so that the jammed chain links slide off these roll-off radii, as it were, in the course of being steered helically into the chain channel and are enabled to assume normal position. According to a preferred embodiment of the invention the spaces between the spiral turns are selected to be wider by 1.2 to 1.5 times and the hollow core diameter larger by 1.2 to 1.5 times the width of the chain links. It is also provided for the pitch of the spiral turns to be selected so that the freedom of motion for perfect return of jammed chain links into their normal position and their entry into the chain channel of the plane guidance system is assured at all times.

The advantages achieved by the invention are seen essentially in that a device to guide a coal plane on the conveyor trough of a conveyor, is realized which, due to an intake spiral, is characterized by excellent entry even of jammed chain links into the chain channel of the plane guidance system so that chain deformations and chain breakages with the operating breakdowns resulting therefrom no longer have to be feared. This is accomplished with a relatively simple and functional design in which the spaces between the turns of the intake spiral are such that small coal particles taken along drop off and cannot penetrate the chain channels. These small coal particles are further discharged through the cutouts in the bottom area of the intake gates so that the plane channels are kept free to the greatest possible extent.

Accordingly it is an object of the invention to provide an improved intake gate for a plain chain which has means for guiding the links of the chain such that they are aligned as they are fed into the chain guiding channel.

A further object of the invention is to provide an intake gate for a plane chain which includes means for shifting the links of a chain which comprises a spirally formed intake having spaced apart areas to which the links of the chain are deflected and turned so that they are aligned for feeding into a final chain guiding channel.

A further object of the invention is to provide a coal plane feed device for the chains which is simple in design, rugged in construction and economical to manufacture.

The various features of novelty which characterize the invention are pointed out with particularity in the claims annexed to and forming a part of this disclosure. For a better understanding of the invention, its operating advantages and specific object attained by its uses, reference is made to the accompanying drawings and descriptive matter in which preferred embodiments of the invention are illustrated.

DESCRIPTION OF THE PREFERRED EMBODIMENTS

Figure 1:
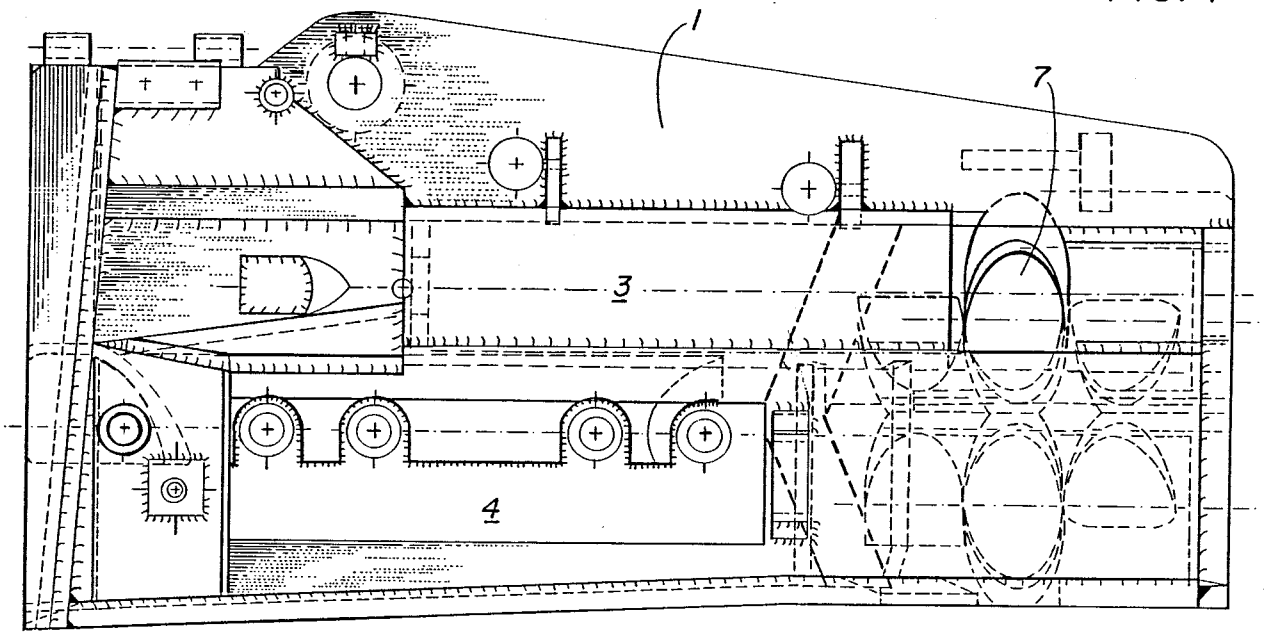
FIG. 1 is a side elevational view of an intake gate with an intake spiral according to the invention.
Figure 2:
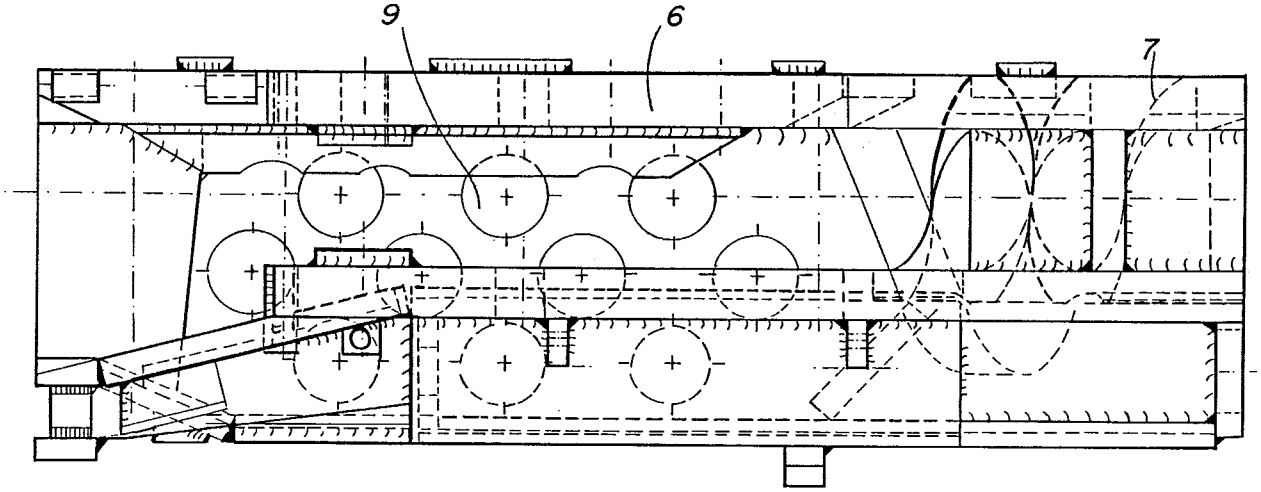
FIG. 2 is a top plan view of the gate shown in FIG. 1.
Figure 3:
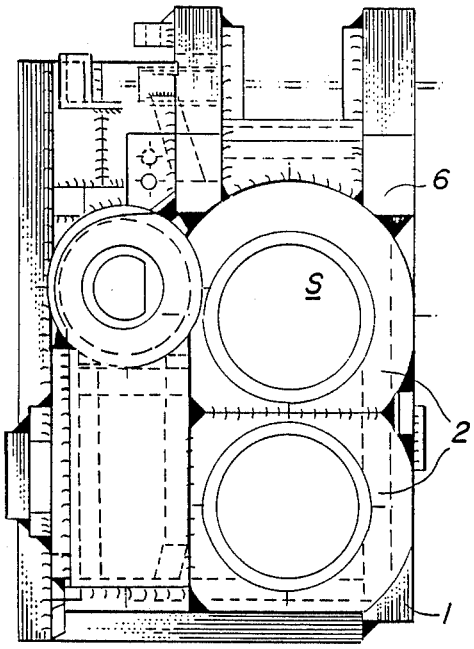
FIG. 3 is a front elevational view in the area of the intake spiral.
Figure 4:
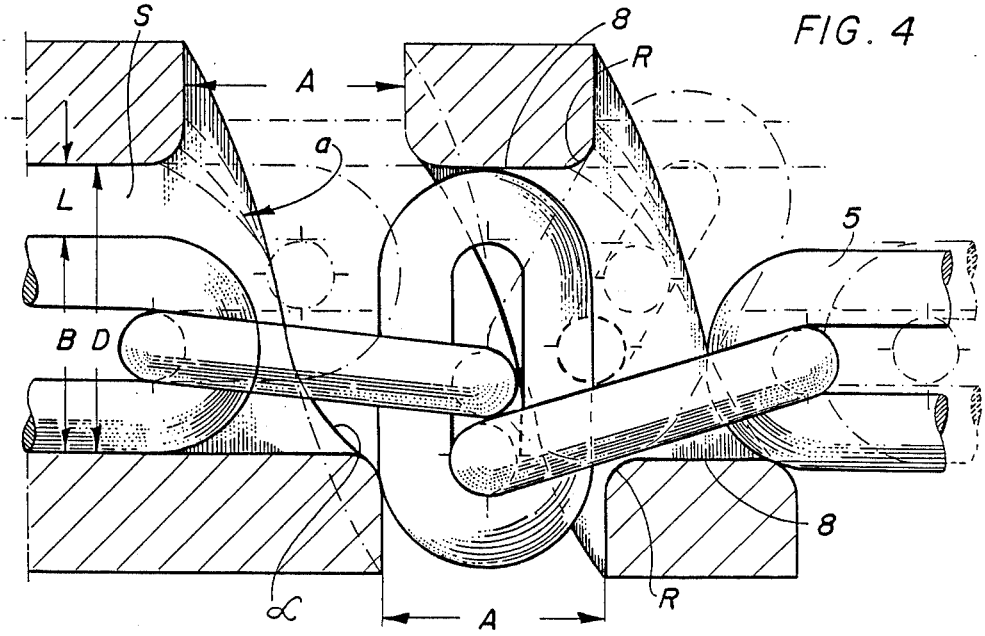
FIG. 4 is an enlarged sectional view of the gate showing the stepwise transition of a jammed chain link into normal position when entering the chain channel of the plane guidance system.

Referring to the drawings in particular the invention embodied therein comprises an intake gate for the plane chain 5 which facilitates the infeed of the chain into a guiding channel for hollow chain guidance profile 2 of a scraper chain conveyor. In accordance with the invention, the links of the chain 5 are guided as indicated in FIG. 4 so that each link is deflected so that it achieves an aligned non jamming arrangement as it passes through the gate portion on its way to the hollow core portion 2. The gate portion in accordance with the invention comprises spaced spiral wall portions with a space therebetween having a width for axial space A. In addition the convolusions of the gate are formed with a radius R which affects the rolling off of the chain links which are misaligned from the dotted line position indicated in FIG. 4 to the solid position which they will assume when they enter into the chain guidance portion or hollow core S of the chain conveyor after passing through the gate having the spiral turns 8.

In the figures is illustrated a device to guide a coal plane, including chain guidance profiles 2 fastened to the chain trough 1 with an upper and lower chain channels 3 and 4 for a planing chain 5, the plane guiding end profiles disposed at both ends of the plane guiding system or the attached intake gates 6 being designed for the entry of the planing chain 5. The plane guiding end profiles or the intake gates 6 attached to the plane guidance system have, in the area of the chain channel 3, an intake spiral 7 of helical nature with a hollow core S for the planing chain 5, the axial space A between the spiral turns 8 being selected wider by a given dimension and the hollow core diameter D being selected larger by a given dimension than the width B of the chain links of the planing chain 5. Furthermore, the pitch $\alpha$ of the spiral turns 8 is selected so that, when sectioning the intake spiral 7 axially, the free spaces A between the spiral turns 8 are alternately opposite each other. The intake spiral 7 has at least two spiral turns 8. The inner edges of the spiral turns 8 are designed as roll-off radii R of given size. The spaces A between spiral turns are selected to be 1.2 to 1.5 times wider and the hollow core diameter D 1.2 to 1.5 times larger than the width B of the chain links to that normal position and ultimately their entry into the chain channel 3 is assured. Chain links have the clearance L required therefore. Disposed in the bottom area of the intake gates 6 are cutouts 9 or breakthroughs for the discharge of small coal particles.

While specific embodiments of the invention have been shown and described in detail to illustrate the application of the principles of the invention, it will be understood that the invention may be embodied otherwise without departing from such principles.

What is claimed is:

1. An intake gate for guiding a planing chain, which chain is made up of individual closed links which are fed through a relatively small channel of the conveyor, comprising an intake gate body made up of a plurality of helical wall turns having spaces between said turns which are wider than the guiding channel for the chain of the conveyor and are selected larger by a selected dimension than the width of the chain links and which includes a pitch of the spiral turns selected so that when sectioning the intakes spiral of the turns axially, the free spaces between the spiral turns and the spiral turns are opposite to each other.

2. An intake gate according to claim 1, wherein the intake spiral has at least two spiral turns.

3. An intake gate according to claim 1, wherein the inner edges of said spiral turn portions are formed with roll-off curves of selected radii.

4. An intake gate according to claim 1, wherein the spaces between said spiral turns are selected to be from 1.2 to 1.5 times wider than the diameter of the channel for the chains and from 1.2 to 1.5 times larger than the width of the chain links.

5. An intake gate according to claim 4 wherein the pitch of said spiral turns depends upon the chain width, the chain guidance system and the freedom of motion with respect to the diameter of the chain channel.

6. An intake gate according to claim 1, including cutouts in said intake body for the discharge of small coal particles.

* * * * *